US006112796A

United States Patent [19]

Stevens

[11] Patent Number: 6,112,796

[45] Date of Patent: Sep. 5, 2000

[54] TAPE DISPENSER

[75] Inventor: Christopher John Stevens, Reading, United Kingdom

[73] Assignee: The Gillette Company, Boston, Mass.

[21] Appl. No.: 09/039,828

[22] Filed: Mar. 16, 1998

Related U.S. Application Data

[63] Continuation of application No. PCT/US96/15568, Sep. 27, 1996.

[30] Foreign Application Priority Data

Oct. 2, 1995 [GB] United Kingdom ..... 9520086

[51] Int. Cl.[7] ..... B65H 20/26

[52] U.S. Cl. ..... 156/577; 156/238; 156/579; 242/364.1; 242/537; 242/588.2; 242/588.3

[58] Field of Search ..... 156/238, 247, 156/540, 543, 577, 579; 242/364.1, 328, 577, 588.3, 588.2, 537; 401/261

[56] References Cited

U.S. PATENT DOCUMENTS

| | | | |
|---|---|---|---|
| 2,493,737 | 1/1950 | Burns | 156/523 |
| 2,797,880 | 7/1957 | Miller et al. | 242/577 |
| 3,274,038 | 9/1966 | Karn | 156/247 |
| 4,427,160 | 1/1984 | Myers | 242/326.4 |
| 5,735,482 | 4/1998 | Kuzik | 242/537 |
| 5,820,728 | 10/1998 | Stevens et al. | 156/577 |

FOREIGN PATENT DOCUMENTS

| | | |
|---|---|---|
| 4104331 | 8/1992 | Germany . |
| 9210420 | 6/1992 | WIPO . |

*Primary Examiner*—Linda L. Gray
*Attorney, Agent, or Firm*—Chester Cekala

[57] ABSTRACT

The tape dispenser has a housing accommodating a tape. The tape consists of a carrier ribbon carrying a coating of a composition. The housing also accommodates used carrier ribbon from which the composition has been removed. The supply of tape is held in an elongated reel wound around a pair of spaced and independently rotatable spool members. Ends of the carrier ribbon are connected together, and the used carrier ribbon is stored on the reel with remaining unused tape.

5 Claims, 2 Drawing Sheets

TAPE DISPENSER

This is a continuation of PCT/US96/15568, filed Sep. 27, 1996, now WO 97/12827.

BACKGROUND OF THE INVENTION

This invention relates to tape dispensers of the kind in which a coating composition to be laid down onto a substrate surface is supplied carried on a ribbon and in use of the dispenser the coating composition is transferred onto the substrate surface as a continuous strip while the carrier ribbon is retained by the dispenser. Such tape dispensers are known, and are used for example for applying a correction composition to cover a writing or typing mistake and to enable a correction to be made. In these known correction tape dispensers, separate tape supply and take up spools are generally provided within the dispenser casing, and the two spools are linked by a drive mechanism so that as tape is drawn for use from the supply spool the take up spool is rotated to wind up the used carrier ribbon. Also, as the rotational speeds of the spools are not the same, some form of clutch mechanism is usually demanded. The need for a clutch increases the manufacturing costs which is a disadvantage, especially as most dispensers are intended to be discarded after the initial tape supply has been used up. Because, when first manufactured and used essentially all the tape is carried by the supply spool, whereas at final use the supply spool is empty and all the carrier ribbon is wound onto the take up spool, the respective spools require considerable space within the dispenser body which also serves as a handle for holding the dispenser during use. Consequently, the length of tape which can be supplied in a dispenser is limited if the body is not to become large and, as a result, make the dispenser cumbersome and inconvenient to use. This drawback is especially acute where it is desired to provide a dispenser with a slim elongated body or handle to enable it to be held in similar manner to the way in which a pen or marker is held in the hand.

BRIEF SUMMARY OF THE INVENTION

To alleviate the above drawbacks, the present invention provides a tape dispenser comprising a body housing a supply of tape consisting of a carrier ribbon carrying a coating of a composition to be transferred onto a substrate surface, and arranged to store used carrier ribbon from which the composition has been removed, wherein the supply of tape is held in the form of an elongated reel wound around a pair of spaced and independently rotatable spool members.

Most advantageously the ends of the carrier ribbon are connected together, and the used carrier ribbon is stored in a common reel with the remaining unused tape.

By holding the tape supply in an elongated reel, e.g. an oval reel where the spool members have the same diameter, substantially more tape can be accommodated in an elongated dispenser housing than is possible with conventional tape storage arrangements. Furthermore, by storing the used carrier ribbon in a common reel with the unused tape, it is unnecessary to provide an additional separate space within the housing to accommodate the used ribbon, as is the case with prior art dispensers. With a continuous oval reel from which tape is removed from the inner winding for delivery to an applicator head, and used carrier ribbon is returned to the outermost winding, slippage naturally occurs between the winding layers of the reel. The frictional effects of this slippage can be relied upon to control the tension in the tape in the section extending to and from the applicator head, whereby the need for drive and clutch mechanisms between the spools can be obviated. An alternative method of controlling the tape tension is to mount the spools so that they can move towards each other and provide spring means to urge the spools apart.

BRIEF DESCRIPTION OF THE DRAWINGS

To facilitate a clear understanding of the invention a specific embodiment is described below in greater detail, reference being made to the accompanying drawings, in which.

DETAILED DESCRIPTION OF THE INVENTION

Figure 1:
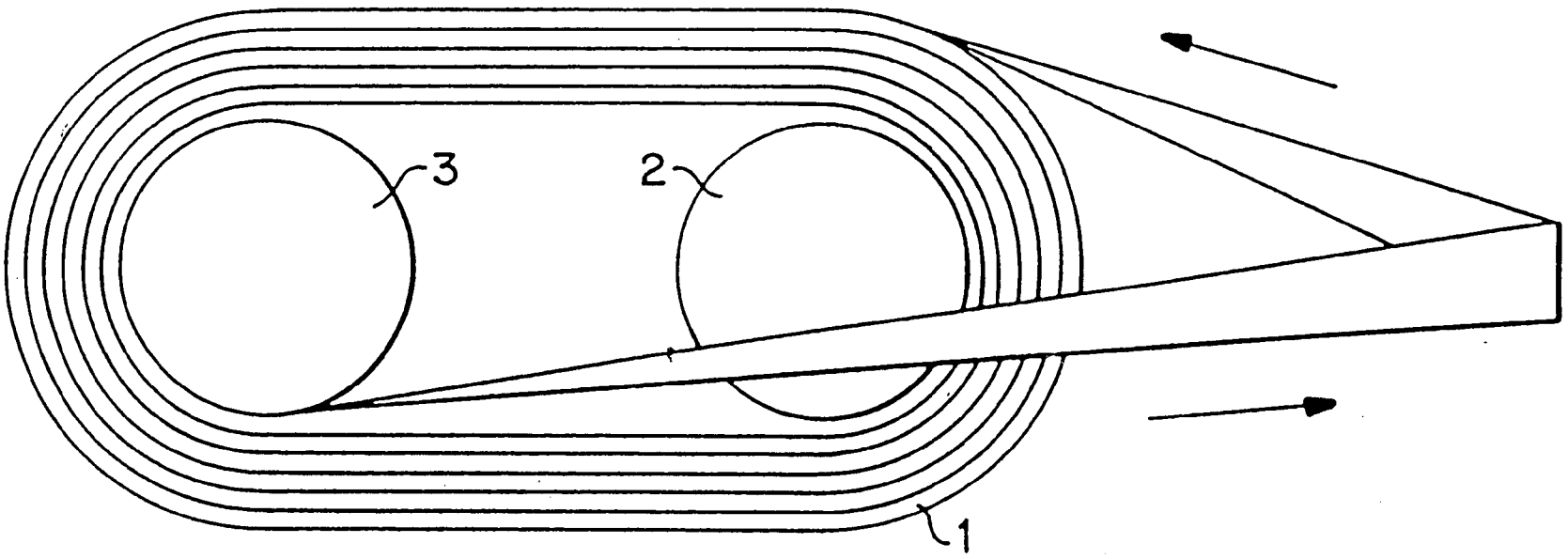
FIG. 1 is a schematic illustration showing the oval spooling of the tape.
Figure 2:
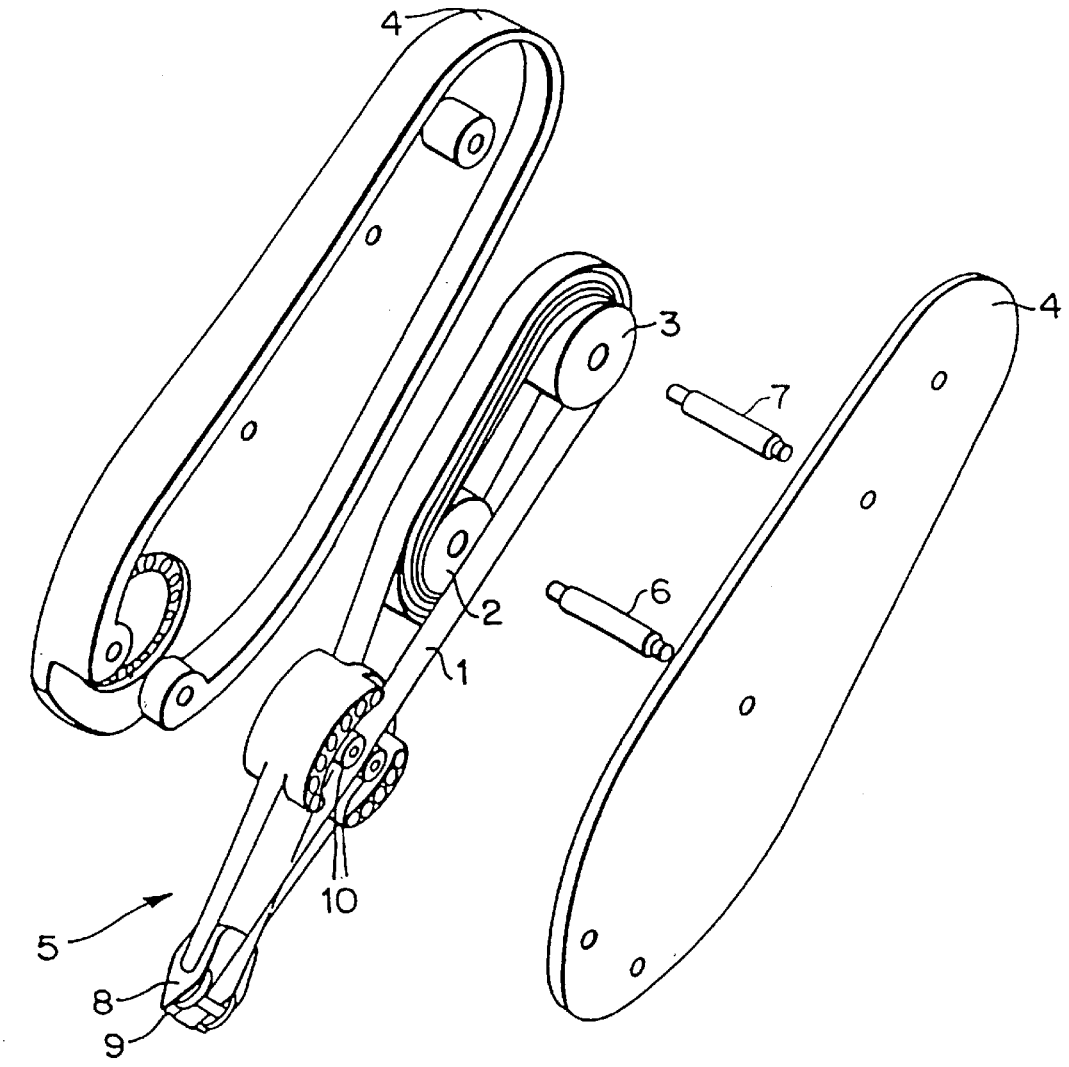
FIG. 2 is an exploded perspective view of a correction tape dispenser in accordance with the invention.

Referring initially to FIG. 1, there is shown a reel of correction tape as held within a correction tape dispenser. The tape 1 is of known type consisting of a length of carrier ribbon, e.g. of plastics or paper, on which is carried the correction composition which will be laid down on a surface by the dispenser. In accordance with this invention, the ends of the carrier ribbon are spliced together so that the ribbon is a continuous loop, and the tape is wound in several superimposed layers around a pair of spaced equal diameter spool members 2, 3, thereby forming an oval reel of tape. As may be seen in FIG. 2, the oval reel is accommodated in an elongate casing 4 of generally slim configuration and as described in more detail below, a section of tape between the inner and outermost windings of the reels is arranged to extend out of the casing and over an applicator head which is used to press the tape against the substrate surface in use of the dispenser. As illustrated in FIG. 2, the casing 4 is assembled from two parts which support between them a pair of spaced spindles 6, 7 on which the two spool members 2, 3 are respectively carried for independent rotation about respective axes. The applicator head 5 projects from the forward end of the casing and at its free end carries a tip 8 with an edge 9 around which the tape passes. The tape is guided to and from the tip by pairs of guide pins or rollers 10. The casing may be pivotally adjustable relative to the applicator head as described in our copending patent application Ser. No 09/039,829. When the tape is pressed against a substrate surface by means of the tip edge 9, and the tip is moved over the surface in a direction substantially perpendicular to the edge, the correction coating is transferred to the surface from the carrier ribbon and becomes laid down as a continuous strip. Fresh tape is drawn from the supply reel. In the illustrated arrangement, the fresh tape is drawn from the innermost winding of the reel at the rearmost spool 3. To assist this separation of the tape from the reel, this spool 3 is preferably given a profile so that it acts to displace the innermost winding out of the plane of the reel. The separated tape passes over the forwardmost spool 2 and to the guide pins/rollers 10 before travelling on to the applicator tip 8. The carrier ribbon having passed around the tip edge 9 and having had the correction composition removed therefrom is guided similarly by a pair of guide pins/rollers 10 before being delivered to the tape reel at the outermost winding near the forward spool 2. As the supply of correction tape is used up the oval reel of tape becomes gradually replaced by the used ribbon, so no additional space is needed within the casing to accommodate the ribbon.

As the tape is delivered from the innermost winding of the oval reel, the outer layers move inwardly and some slippage occurs between adjacent layers. The friction between the slipping layers can be used to ensure the tension needed in the tape to control the portion extending to and around the applicator head is obtained. It will be easily recognized that the amount of tape held in the oval reel of FIG. 1 is substantially greater than would be stored in the same number of layers around a single cylindrical spool.

What is claimed is:

1. A tape dispenser comprising a body housing a supply of tape consisting of a carrier ribbon carrying a coating of a composition to be transferred onto a substrate surface, and arranged to store used carrier ribbon from which the composition has been removed, wherein the supply of tape is held in the form of an elongated reel wound around a pair of spaced and independently rotatable spool members, wherein ends of the carrier ribbon are connected together, and the used carrier ribbon is stored on the reel with remaining unused tape.

2. A tape dispenser according to claim 1, wherein the tape is delivered to an applicator of the dispenser from the innermost winding of the reel.

3. A tape dispenser according to claim 2, wherein one of the spool members is configured to act on the tape portion in contact therewith to displace a tape layer axially of the spool member for delivery from the reel.

4. A tape dispenser according to claim 1 wherein the spool members are moveable towards each other and urged apart by spring means.

5. A tape dispenser according to claim 1 wherein the spool members are of substantially equal diameters.

* * * * *